US009415850B2

(12) United States Patent
Shomura et al.

(10) Patent No.: US 9,415,850 B2
(45) Date of Patent: Aug. 16, 2016

(54) MOUNT DEVICE FOR OUTBOARD MOTOR

(71) Applicant: SUZUKI MOTOR CORPORATION, Shizuoka-Ken (JP)

(72) Inventors: Nobuyuki Shomura, Shizuoka-Ken (JP); Akinori Yamazaki, Shizuoka-Ken (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/646,288

(22) PCT Filed: Nov. 28, 2013

(86) PCT No.: PCT/JP2013/082010

§ 371 (c)(1),
(2) Date: May 20, 2015

(87) PCT Pub. No.: WO2014/087912

PCT Pub. Date: Jun. 12, 2014

(65) Prior Publication Data

US 2015/0298784 A1 Oct. 22, 2015

(30) Foreign Application Priority Data

Dec. 6, 2012 (JP) ..... 2012-267609

(51) Int. Cl.
*B63H 1/15* (2006.01)
*B63H 21/30* (2006.01)
(Continued)

(52) U.S. Cl.
CPC ..... *B63H 21/30* (2013.01); *B63H 20/06* (2013.01); *B63H 20/08* (2013.01); *B63H 20/10* (2013.01)

(58) Field of Classification Search
CPC ..... B63H 20/00; B63H 20/02; B63H 20/06; B63H 20/10; B63H 21/30; B63H 21/305; B63H 2020/00; B63H 2020/02; B63H 2020/025; B63H 2021/30
USPC ..... 440/49, 52, 53, 55
See application file for complete search history.

(56) References Cited

U.S. PATENT DOCUMENTS 3,884,174 A * 5/1975 Larsen ..... B63H 20/06 248/638
3,952,687 A * 4/1976 Brownlie ..... B63H 20/10 440/112

(Continued)

FOREIGN PATENT DOCUMENTS

JP 11099991 A 4/1999
JP 2006312379 A 11/2006

(Continued)

OTHER PUBLICATIONS

English Translation of International Preliminary Report on Patentability and Written Opinion of the International Searching Authority for PCT/JP2013/082010 dated Feb. 25, 2014.

(Continued)

*Primary Examiner* — Daniel V Venne
(74) *Attorney, Agent, or Firm* — Barnes & Thornburg LLP

(57) ABSTRACT

An outboard motor having an outboard motor body generating a thrust by rotating a propeller that is driven by an engine mounted to the outboard motor and an attachment device for attaching the outboard motor body to a hull. The outboard motor includes a mount device having an upper mount and a lower mount arranged between the outboard motor body and the attachment device for attaching the outboard motor body to the hull and supports an upper portion and a lower portion of the outboard motor body, respectively. The mount device also includes an anti-vibration unit and a displacement restriction unit. The lateral displacement restricting mount section and a member opposing the lateral displacement restricting mount section abut against each other with the abutment surfaces inclined with respect to a longitudinal direction of the outboard motor body.

6 Claims, 10 Drawing Sheets

(51) Int. Cl.

| | |
|---|---|
| ***B63H 20/08*** | (2006.01) |
| ***B63H 20/06*** | (2006.01) |
| ***B63H 20/10*** | (2006.01) |

(56) References Cited

U.S. PATENT DOCUMENTS

| | | | | | |
|---|---|---|---|---|---|
| 3,961,595 | A * | 6/1976 | Meyer | B63H 21/305 | 440/52 |
| RE30,122 | E * | 10/1979 | Brownlie | B63H 20/10 | 440/52 |
| 5,503,576 | A * | 4/1996 | Ming | F02B 61/045 | 440/52 |
| 6,645,019 | B1 * | 11/2003 | Shiomi | B63H 20/02 | 440/52 |
| 6,656,003 | B1 * | 12/2003 | Kitsu | B63H 20/12 | 440/52 |
| 2006/0040572 | A1 * | 2/2006 | Mizuguchi | F02B 61/045 | 440/52 |
| 2013/0252492 | A1 * | 9/2013 | Kadobayashi | B63H 20/10 | 440/53 |

FOREIGN PATENT DOCUMENTS

| | | | |
|---|---|---|---|
| JP | 2009298194 | A | 12/2009 |
| JP | 2011057097 | A | 3/2011 |
| JP | 2011093475 | A | 5/2011 |
| JP | 2012025305 | A | 2/2012 |
| JP | 2012081901 | A | 4/2012 |

OTHER PUBLICATIONS

Search Report for International Patent Application No. PCT/JP2013/082010; Feb. 25, 2014.

* cited by examiner

MOUNT DEVICE FOR OUTBOARD MOTOR

PRIORITY CLAIM

This patent application is a U.S. National Phase of International Patent Application No. PCT/JP2013/082010, filed 28 Nov. 2013, which claims priority to Japanese Patent Application No. 2012-267609, filed 6 Dec. 2012, the disclosures of which are incorporated herein by reference in their entirety.

TECHNICAL FIELD

The present invention relates to a mount device for an outboard motor that is arranged between an outboard motor body and an attachment device that attaches the outboard motor body to a hull.

BACKGROUND ART

Generally, in a mount device for an outboard motor disposed between an outboard motor body and an attachment device through which the outboard motor body is attached to a hull, a mount unit including an upper mount unit and a lower mount unit which are arranged in an upper portion and a lower portion of the outboard motor body, and vibration of an engine is prevented from transmitting to the hull by providing an elastic body, such as rubber material, in the mount unit.

In order to improve vibration prevention performance of such mount device, it is necessary to set a spring constant of the elastic body to be small to thereby prevent vibration particularly during low-speed rotation of the engine from transmitting to the hull. However, when a large load is applied to the outboard motor body as in a case in which a thrust of the outboard motor body rapidly changes, only the elastic body may not be able to prevent interference between a member on the outboard motor body side (e.g., an engine holder) and a member on the attachment device side (e.g., a swivel bracket). Patent Document 1 discloses a mount device for an outboard motor that solves the above-mentioned problem.

The mount device for an outboard motor disclosed in Patent Document 1 includes, as shown in FIG. 10, a first upper mount 101 that performs a function to prevent transmission of vibration, a second upper mount 102 that performs a function to restrict displacement of an outboard motor body during forward movement of a hull, a third upper mount 103 that performs a function to restrict displacement of the outboard motor body during backward movement of the hull, a fourth upper mount 104 that performs a function to restrict displacement in right-left and up-down directions of the outboard motor body, and a fifth upper mount 105 that performs a function to restrict rotational displacement in a yaw direction (a rotational direction about a gravity center position O within a horizontal plane of the outboard motor body) of the outboard motor body.

PRIOR ART DOCUMENTS

Patent Document

Patent Document 1: Japanese Patent Laid-Open No. 2006-312379

DISCLOSURE OF THE INVENTION

Problems to be Solved by the Invention

In the mount device for an outboard motor shown in FIG. 10, the first upper mount 101 that performs the function to prevent the transmission of vibration during the low-speed rotation of an engine is desired to have a small spring constant relative to a vibration frequency of the engine or the like. Thus, a spring constant of mount rubber of the first upper mount 101 is set to be very small.

On the other hand, in the second upper mount 102 and the third upper mount 103 that perform a function to transmit the thrust from the outboard motor body to the hull as well as the function to restrict the displacement during the forward movement and the backward movement, and the fourth upper mount 104 that performs a function to transmit the steering force from the hull side to the outboard motor body as well as the function to restrict the displacement in the right-left and up-down directions, spring constants of the second upper mount 102, the third upper mount 103 and the fourth upper mount 104 are set to be large in order to efficiently transmit the thrust and the steering force. A spring constant of the fifth upper mount 105 that restricts the rotational displacement is also set to be large.

By the way, when the spring constant of the first upper mount 101 is decreased, the displacement needs to be increased. Thus, for example, in order to prevent the fourth upper mount 104 and the fifth upper mount 105 from functioning, both of a gap M between a side wall 106A of an upper mount housing section 106 to which the fourth upper mount 104 opposes and the fourth upper mount 104, and a gap N between an abutment section 106B of the upper mount housing section 106 to which the fifth upper mount 105 opposes and the fifth upper mount 105 are set to be large.

However, when the gaps M and N are set to be large as described above, a steering response and a displacement restricting function particularly at a time when the engine rotates at high speed are deteriorated. Therefore, in order to achieve both of the vibration transmission preventing function by the first upper mount 101 and the displacement restricting function and the steering response by the second to fifth upper mounts 102 to 105, it is required for the gaps M and N to be as small as possible and also required for the fourth upper mount 104 and the fifth upper mount 105, particularly, mount rubber, to be worked with high accuracy.

The present invention has been made in consideration of the above circumstances, and an object of the present invention is to provide a mount device for an outboard motor capable of decreasing a manufacturing cost by reducing a requirement for machining accuracy of a mount device for restricting displacement in several directions including a lateral direction and etc. and also capable of improving a displacement restricting function and a steering response during high speed rotation of an engine.

Means for Solving the Problems

The above object can be achieved by the present invention by providing a mount device for an outboard motor having an outboard motor body generating a thrust by rotating a propeller that is driven by an engine mounted to the outboard motor and an attachment device configured to attach the outboard motor body to a hull, the mount device including an upper mount unit and a lower mount unit arranged between the outboard motor body and the attachment device for attaching the outboard motor body to the hull and configured to support an upper portion and a lower portion of the outboard motor body, respectively, the upper and lower mount units each further comprising first upper and lower mount sections that prevents vibration of the engine during low-speed rotation of the engine from being transmitted to the hull, a forward-movement side displacement restriction mount section that restricts displacement of the outboard motor body during high-speed rotation of the engine and during forward movement of the hull, a backward-movement side displacement restriction mount section that restricts displacement of the outboard motor body during backward movement of the hull, and a lateral displacement restriction mount section that restricts displacement in directions including a rolling direction and a yaw direction of the outboard motor body, and wherein the lateral displacement restriction mount section and a member opposing to the lateral displacement restriction mount section abut against each other at abutment surfaces thereof, the abutment surfaces being configured to be inclined with respect to a longitudinal direction of the outboard motor body.

In the embodiment of the mount device for an outboard motor having the above characteristic features, the following preferable modes or aspects may be provided.

It may be preferred that the lateral displacement restriction mount section is arranged on respective sides of the longitudinal direction of the outboard motor body with the vibration prevention mount section being disposed therebetween.

It may be preferred that the lateral displacement restriction mount section is installed on each of opposing lateral side surfaces of a core metal member at which the forward-movement side displacement restriction mount section and the backward-movement side displacement restriction mount section are mounted.

It may be preferred that the lateral displacement restriction mount section of the upper mount unit is installed on an engine holder of the outboard motor body that supports the engine in a manner opposing to an upper mount bracket that is the opposing member.

It may be preferred that the lateral displacement restriction mount section of the lower mount unit is mounted on a lower mount bracket with a portion of a drive shaft housing of the outboard motor body being formed as the opposing member.

It may be preferred that the respective mounts have spring constants that are respectively set so as to satisfy the vibration prevention mount section<the forward-movement side displacement restriction mount section=the backward-movement side displacement restriction mount section<the lateral displacement restriction mount section.

Effects of the Invention

According to the present invention of the characters mentioned above, a gap between the respective abutment surfaces of the lateral displacement restriction mount section (i.e., lateral displacement restriction mount section including a rolling direction and a yaw direction) and the opposing member is decreased during the high-speed rotation of the engine and during the forward movement of the hull, and therefore, a displacement restricting function during the high-speed rotation of the engine and a steering response can be improved. Furthermore, since the gap between the respective abutment surfaces of the above lateral displacement restriction mount section and the opposing member is set to be large enough not to interfere the abutment surfaces with each other even by the vibration of the engine during the low-speed rotation of the engine, it is possible to reduce a requirement for machining accuracy of the above lateral displacement restriction mount section, and to reduce a manufacturing cost of the right-left etc. displacement restriction mount.

EMBODIMENTS FOR CARRYING OUT THE INVENTION

Figure 1:
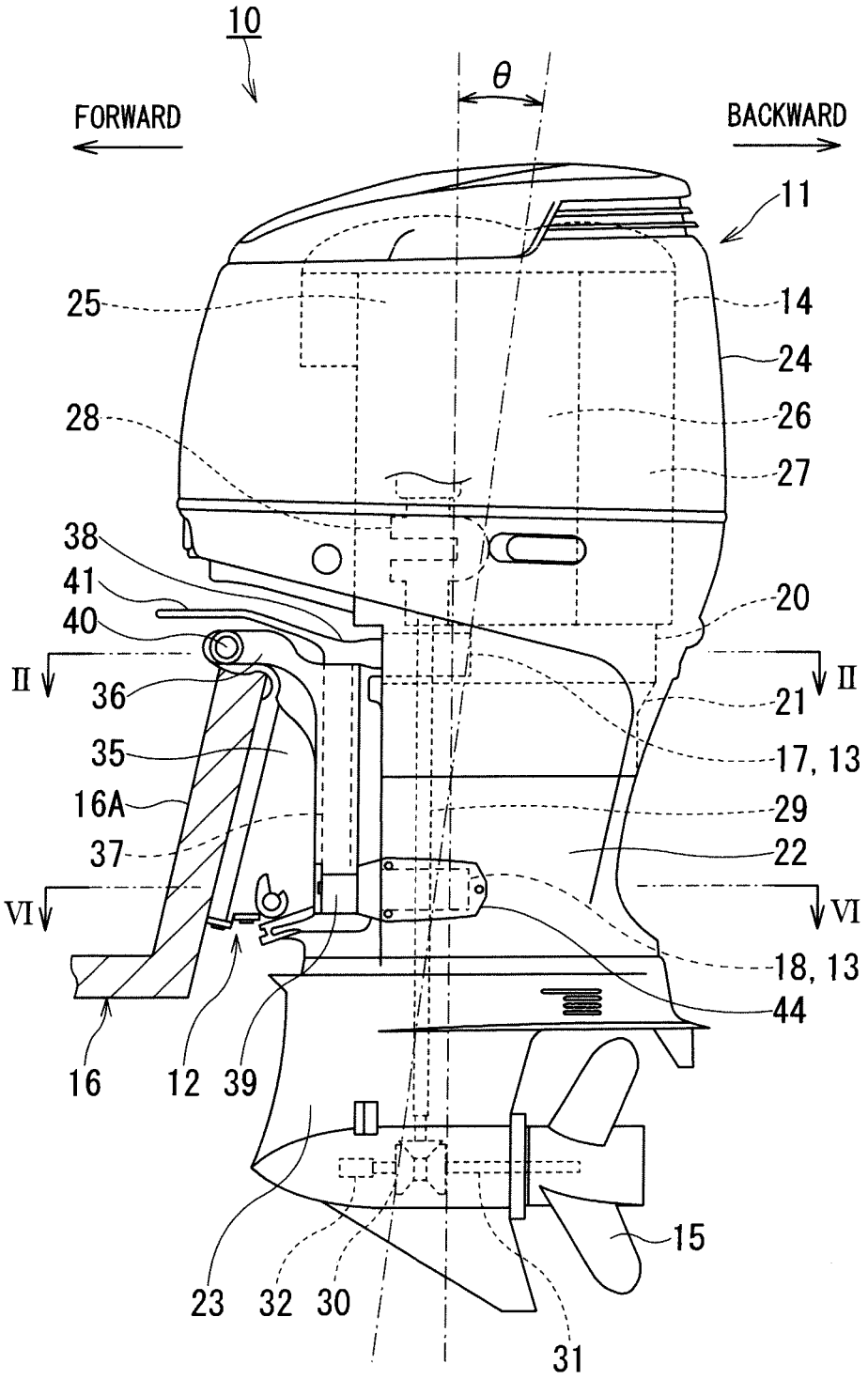
FIG. 1 is a left side view illustrating an outboard motor to which one embodiment of a mount device for an outboard motor according to the present invention is applied.

An embodiment for carrying out the present invention is described hereinafter with reference to the accompanying drawings. FIG. 1 is a left side view illustrating an outboard motor to which one embodiment of a mount device for an outboard motor according to the present invention is applied. It is to be noted that terms indicating directions such as "upper", "lower", "right", "left" and like indicating direction are used herein with reference to an illustrated state or in a state in which the outboard motor is attached to a hull.

As shown in FIG. 1, an outboard motor 10 includes an outboard motor body 11 that generates a thrust to a front side or a rear side of the outboard motor by transmitting a drive force of a mounted engine 14 to a propeller 15 to rotate the propeller 15, an attachment bracket device 12 as an attachment device that supports the outboard motor body 11 and attaches the outboard motor body 11 to a transom 16A of a hull 16, and a mount device 13 that is disposed between the outboard motor body 11 and the attachment bracket device 12 and includes an upper mount unit 17 and a lower mount unit 18.

The outboard motor body 11 includes an engine holder 20, and the engine 14 is incorporated in the engine holder 20. An oil pan 21 is arranged below the engine holder 20. A drive shaft housing 22 and a gear case 23 are arranged in a lower portion of the oil pan 21 and in a lower portion of the drive shaft housing 22, respectively. The engine 14, the engine holder 20, and the oil pan 21 are covered with an engine cover 24.

In the engine 14, a crankcase 25, a cylinder block 26, and a cylinder head 27 are sequentially arranged from the front side to the rear side of the outboard motor. A cylinder in which a piston reciprocates (both of which are not shown) is formed in the cylinder block 26 in a substantially horizontal direction. A crankshaft 28 is arranged between the crankcase 25 and the cylinder block 26 in a substantially vertical direction.

A drive shaft 29 is connected to a lower end portion of the crankshaft 28 of the engine 14 on the same straight line. The drive shaft 29 extends in the substantially vertical direction within and through the engine holder 20, the oil pan 21, the drive shaft housing 22, and the gear case 23, and is then connected to a propeller shaft 31 via a bevel gear 30 in the gear case 23. Accordingly, the drive force of the engine 14 (that is, a rotational force of the crankshaft 28) is transmitted to the propeller 15 coupled to the propeller shaft 31 through the drive shaft 29, the bevel gear 30, and the propeller shaft 31.

A shift device 32 that switches a rotating direction of the propeller shaft 31 to a normal rotating state (forward movement), a reverse rotating state (backward movement), or a neutral state by a remote operation is provided in the gear case 23. A shift rod, not shown, extends upward from the shift device 32, and the shift rod is operated from the outside of the outboard motor body 11 via a clutch rod, not shown.

The above-mentioned attachment bracket device 12 includes a clamp bracket 35, a swivel bracket 36, a steering shaft 37, an upper mount bracket 38, and a lower mount bracket 39 as also shown in FIG. 1. The clamp bracket 35 is provided so as to be able to grasp the transom 16A of the hull 16. The swivel bracket 36 is supported on the clamp bracket 35 to be rotatable in the vertical direction via a pivot shaft 40.

The steering shaft 37 is rotatably provided so as to extend in a direction perpendicular to the swivel bracket 36. The upper mount bracket 38 as a base end portion of a steering bracket 41 and the lower mount bracket 39 are coupled to an upper end and a lower end of the steering shaft 37, respectively, so as to be rotatable together with the steering shaft 37. The outboard motor body 11 is attached to the upper mount bracket 38 via the upper mount unit 17 and to the lower mount bracket 39 via the lower mount unit 18.

Accordingly, the outboard motor body 11 is pivoted to be rotatable about the steering shaft 37 in the lateral (i.e., right-and-left or horizontal) direction with respect to the clamp bracket 35 and the swivel bracket 36, and is also pivoted to be rotatable (to enable a tilt operation and a trim operation) about the pivot shaft 40 together with the swivel bracket 36 in the vertical direction with respect to the clamp bracket 35.

The upper mount unit 17 constituting the mount device 13 is installed in a front portion of the engine holder 20 and is connected to the upper mount bracket 38 (the steering bracket 41) by means of upper mount bolts 42, and further, a detailed description is made later by using FIGS. 2 to 5. The lower mount unit 18 constituting the mount device 13 is provided in each of opposite side portions of the drive shaft housing 22, and a detailed description is made later by using FIGS. 6 to 9. The respective lower mount units 18 are connected to the lower mount bracket 39 by means of lower mount bolts 43. Reference numeral 44 denotes a lower mount cover covering the lower mount unit 18. The upper mount unit 17 and the lower mount units 18 prevent vibration of the engine 14 of the outboard motor body 11 from being transmitted to the hull 16, and restrict excessive displacement of the outboard motor body 11 with respect to the hull 16.

It is further to be noted that, as shown in FIG. 1, in the outboard motor 10, the outboard motor body 11 supported by the upper mount unit 17 and the lower mount units 18 is inclined by an inclination angle θ by a forward thrust force generated by the rotation of the propeller 15. Further, by such thrust force, an upper half portion supported by the upper mount unit 17 and including the engine holder 20 is also displaced backward, and a lower half portion supported by the lower mount units 18 and including the drive shaft housing 22 is also displaced forward.

Figure 2:
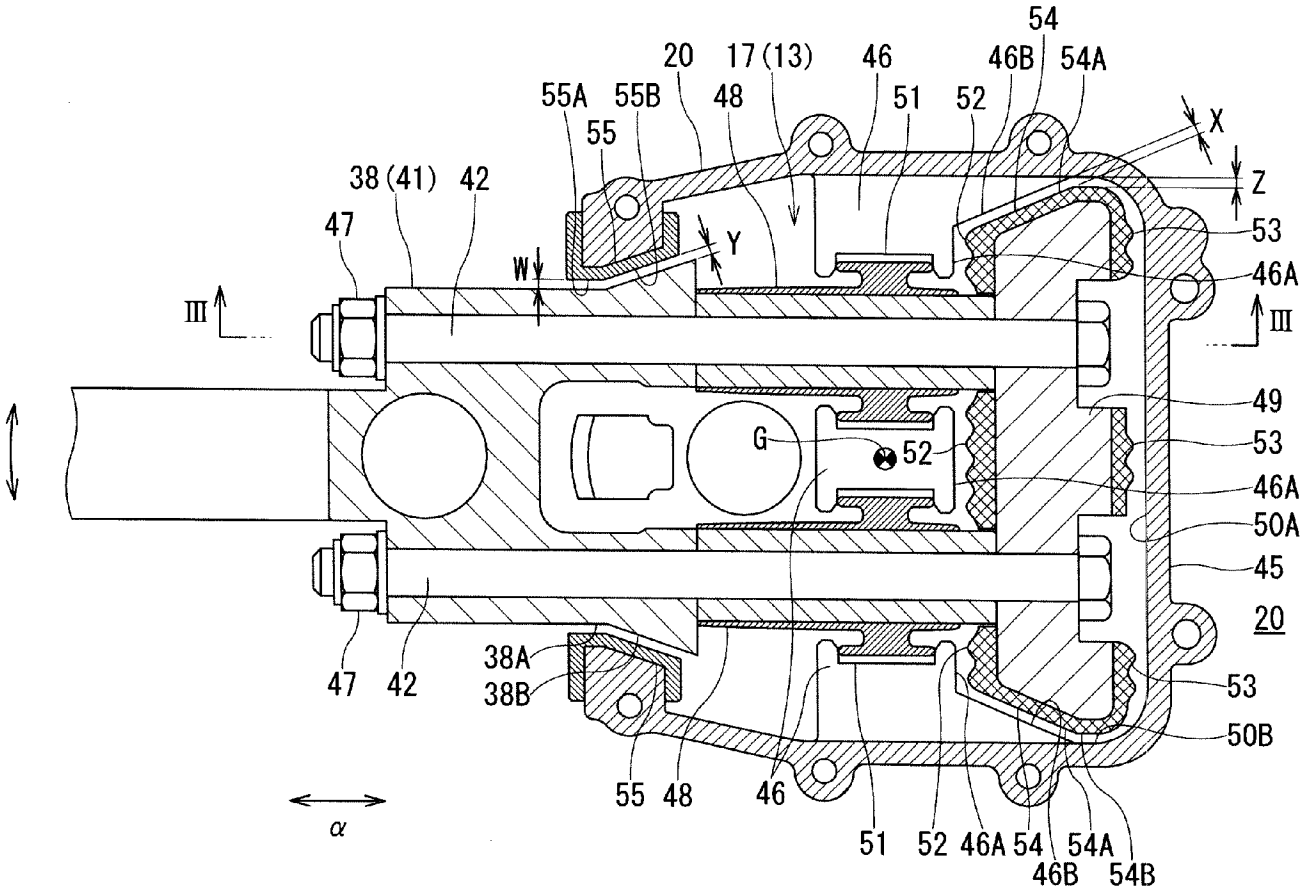
FIG. 2 is a sectional view of an upper mount unit taken along the line II-II in FIG. 1.
Figure 3:
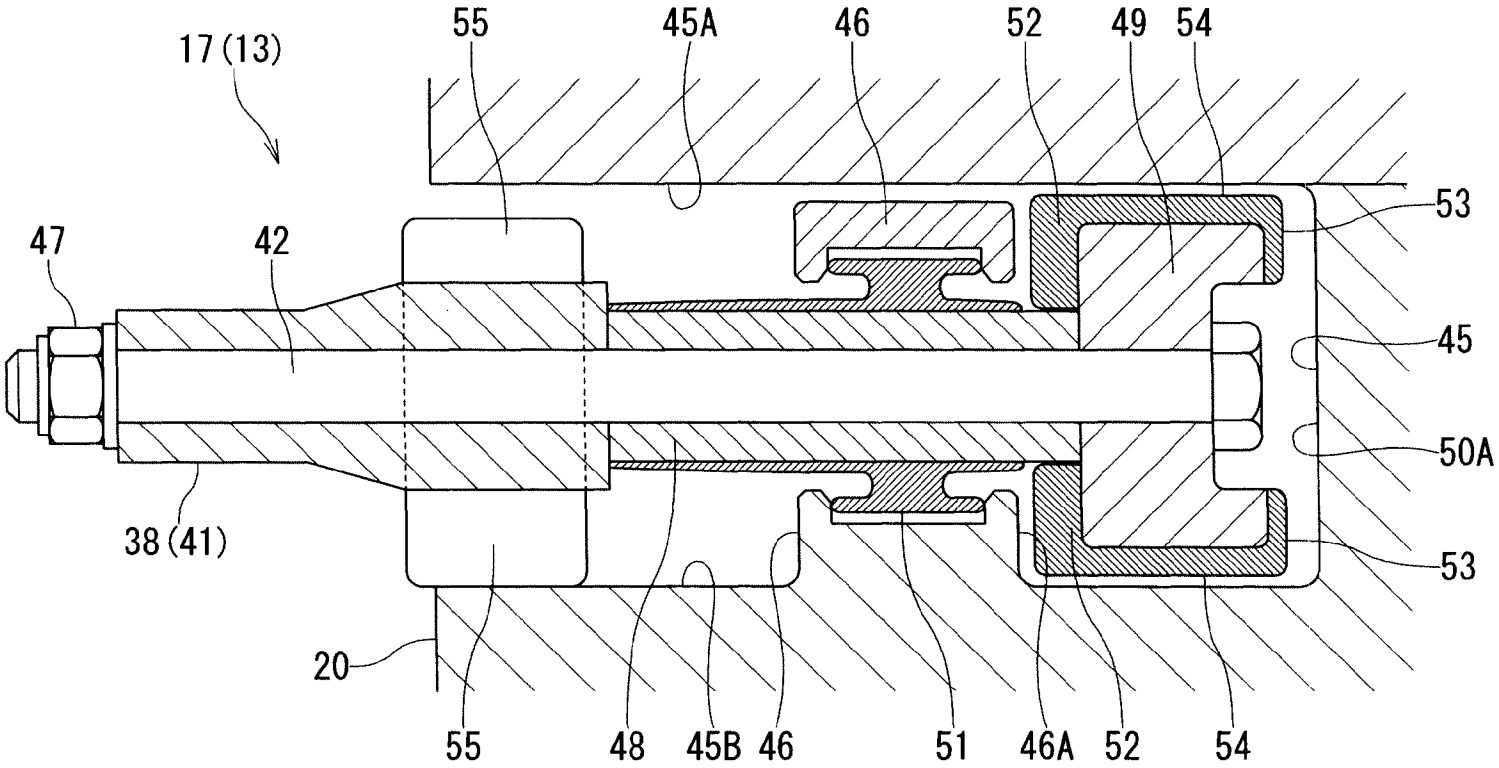
FIG. 3 is a sectional view taken along the line III-III in FIG. 2.

As shown in FIGS. 2 and 3, an upper mount accommodation (housing) section 45 that accommodates the upper mount unit 17 is formed in the front portion of the engine holder 20, and an upper mount holding section 46 is formed in the upper mount accommodation (housing) section 45 integrally with the engine holder 20. The upper mount unit 17 is fixed to the upper mount bracket 38 with front end portions of the upper mount bolts 42 penetrating the upper mount bracket 38 (the steering bracket 41) and fastening nuts 47 screwed to the front end portions in a state in which the upper mount unit 17 is accommodated in the upper mount accommodation section 45 of the engine holder 20.

The upper mount unit 17 is composed of first to fifth upper mount sections or members described below.

That is, the upper mount unit 17 includes first to fifth upper mount sections 51 to 55. The first upper mount section 51 formed of an elastic body such as rubber is wound around each of inner tubes 48 through which the right and left pair of upper mount bolts 42 are inserted, and is fitted to the upper mount holding section 46. The second upper mount section 52 formed of an elastic body such as rubber is interposed between a front surface of a core metal member 49 provided at rear end portions of the right and left pair of upper mount bolts 42, and the upper mount holding section 46. The third upper mount section 53 formed of an elastic body such as rubber is interposed between a rear surface of the core metal member 49 and a rear wall 50A of the upper mount accommodation section 45. The fourth upper mount section 54 formed of an elastic body such as rubber or a resin material is interposed between right and left opposite side surfaces of the core metal member 49 and the upper mount holding section 46. The fifth upper mount section 55 formed of an elastic body such as rubber or a resin material is interposed between a front portion of the upper mount accommodation section 45 and the upper mount bracket 38 (the steering bracket 41). Each of the above first to fifth upper mount sections 51 to 55 will be described hereinafter in more detail.

The first upper mount section 51 functions as a vibration prevention mount member that prevents vibration generated during low-speed rotation of the engine 14 from being transmitted to the hull 16, and this first upper mount section 51 has a very small (soft) spring constant that enables vibration in a longitudinal (i.e., front-and-rear) direction and the lateral (i.e., right-and-left) direction. The first upper mount section 51 is arranged around a gravity center position G of the outboard motor body 11 so as to easily hold a load of the outboard motor body 11 in the tilt or trim operation of the outboard motor body 11. Therefore, the spring constant of the first upper mount section 51 in the vertical direction is set to an appropriate value required for holding the load of the outboard motor body 11.

The second upper mount section 52 is attached to the front surface of the core metal member 49. A slight gap is formed between the front surface of the second upper mount section 52 and a rear surface 46A of the upper mount holding section 46, which is a member opposing to a front surface of the second upper mount section 52. The engine holder 20 of the outboard motor body 11 is displaced backward (in a direction shown with an arrow A in FIG. 4) by the forward thrust generated by the propeller 15 during the high-speed rotation of the engine 14 in the forward movement. The second upper mount section also 52 functions as a forward movement-side displacement restriction mount member that restricts the backward displacement of the engine holder 20. For example, when the engine holder 20 of the outboard motor body 11 is displaced backward, the first upper mount section 51 is first deformed, and a displacement exceeding the displacement absorbed by the first upper mount section 51 is restricted with the front surface of the second upper mount section 52 abutting against the rear surface 46A of the upper mount holding section 46.

Therefore, the spring constant of the second upper mount section 52 is set to a spring constant large enough to prevent the vibration from transmitting of a constant level and restrict the displacement by the forward thrust of the propeller 15, that is, a medium level larger than the spring constant of the first upper mount section 51. When the forward thrust is generated by the propeller 15, the front surface of the second upper mount section 52 is maintained in a state in abutment against the rear surface 46A of the upper mount holding section 46, and a steering force is transmitted to the entire outboard motor body 11 through the engine holder 20.

The third upper mount section 53 is attached to the rear surface of the core metal member 49. A slight gap is formed between the rear wall 50A of the upper mount accommodation section 45, which is a member opposing to the rear surface, and a rear surface of the third upper mount section 53. The engine holder 20 of the outboard motor body 11 is displaced forward (in a direction shown with an arrow B in FIG. 5) by a backward thrust of the propeller 15 during the backward movement. The third upper mount section 53 functions as a backward movement-side displacement restriction mount member that restricts the forward displacement of the engine holder 20.

For example, when the engine holder 20 of the outboard motor body 11 is displaced forward, the first upper mount section 51 is first deformed, and a displacement exceeding the displacement absorbed by the first upper mount section 51 is restricted with the rear surface of the third upper mount section 53 abutting against the rear wall 50A of the upper mount accommodation section 45. A spring constant of the third upper mount section 53 is set to a medium level similarly to the second upper mount section 52.

The fourth upper mount section 54 and the fifth upper mount section 55 are arranged on respective sides of the longitudinal direction (i.e., front-and-rear direction or hull travelling direction) a of the outboard motor body 11 with the first upper mount section 51 therebetween as shown in FIGS. 2 and 3. That is, the fourth upper mount section 54 is attached so as to cover the both lateral side surfaces of the core metal member 49, and an upper surface and a lower surface close to the opposite side surfaces. A slight gap is formed with a rear surface 46B of the upper mount holding section 46, and a rear side (wall) surface 50B, an upper surface 45A, and a lower surface 45B of the upper mount accommodation section 45, which are opposing members.

The fifth upper mount section 55 is attached so as to cover lateral (right and left) side surfaces of the front portion of the upper mount accommodation section 45, and an upper surface and a lower surface close to the opposite side surfaces. A slight gap is formed with side surfaces 38A and 38B of the upper mount bracket 38 (the steering bracket 41), and the upper surface 45A and the lower surface 45B of the upper mount accommodation section 45, which are opposing members.

The fourth upper mount section 54 and the fifth upper mount section 55 function as a displacement restriction mount member for restricting displacement in lateral direction that includes a rolling direction and a yaw direction (hereinafter, which may be called lateral displacement restriction displacement mount section, for the sake of convenience) of the outboard motor body 11 with respect to the hull 16 generated during the steering operation or when the hull 16 lands on water after jumping. For example, during the steering operation, a lift (lift force) is generated on the underwater gear case 23 of the outboard motor body 11, and the outboard motor body 11 is displaced in the lateral direction including the roiling direction and the yaw direction by the lift. At this time, the first upper mount section 51 is deformed first. When a larger load is applied, the fourth upper mount section 54 abuts against the rear surface 46B of the upper mount holding section 46 and the rear side surface 50B of the upper mount accommodation section 45, and the fifth upper mount section 55 abuts against the side surfaces 38A and 38B of the upper mount bracket 38 to thereby restrict the displacement, respectively. Further, it is herein to be noted that the rolling direction means a direction in which the outboard motor body 11 rolls (i.e., tilts) in the lateral direction within a perpendicular plane with the gravity position G of the outboard motor body 11 being the center of rolling, and the yaw direction means a direction in which the outboard motor body 11 rotates (turns its direction) within a horizontal plane about the gravity position G.

Therefore, the spring constants of the fourth upper mount section 54 and the fifth upper mount section 55 are set to the spring constants capable of restricting the displacement of the outboard motor body 11 even when an excessive load is applied, that is, to the spring constants larger than the spring constants of the second upper mount section 52 and the third upper mount section 53.

Further, a side surface 54A acting as an abutment surface of the fourth upper mount section 54 and the rear surface 46B acting as an abutment surface of the upper mount holding section 46 opposing to the side surface 54A are formed so as to provide a tapered shape in which a front side is inclined inward in the lateral direction with respect to the longitudinal direction $\alpha$ of the outboard motor body 11. A side surface 54B acting as an abutment surface of the fourth upper mount section 54 and the rear side surface 50B acting as an abutment surface of the upper mount accommodation section 45 opposing to the side surface 54B are formed in parallel to the longitudinal direction $\alpha$ of the outboard motor body 11.

On the other hand, a side surface 55A acting as an abutment surface of the fifth upper mount section 55 and the side surface 38A acting as an abutment surface of the upper mount bracket 38 (the steering bracket 41) opposing to the side surface 55A are formed in parallel to the longitudinal direction $\alpha$ of the outboard motor body 11. A side surface 55B acting an abutment surface of the fifth upper mount section 55 and the side surface 38B acting as an abutment surface of the upper mount bracket 38 (the steering bracket 41) opposing to the side surface 55B are formed so as to provide a tapered shape in which a front side is inclined inward in the lateral direction with respect to the longitudinal direction $\alpha$ of the outboard motor body 11.

Figure 4:
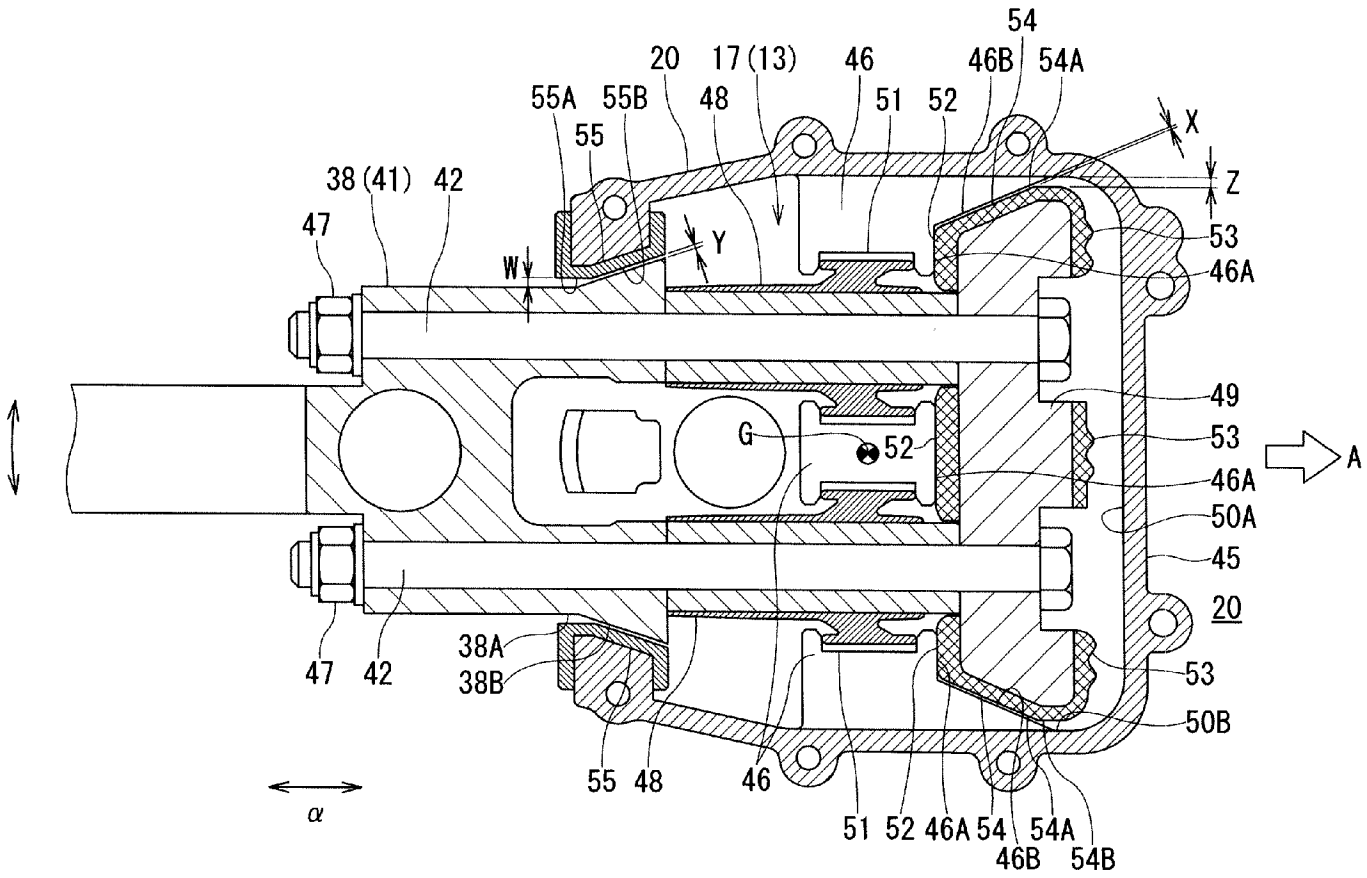
FIG. 4 is a sectional view corresponding to FIG. 2 illustrating a state of the upper mount unit during forward movement of the outboard motor.

Both of the side surface 54A of the fourth upper mount 54 section and the rear surface 46B of the upper mount holding section 46, and both the side surface 55B of the fifth upper mount section 55 and the side surface 38B of the upper mount bracket 38 are formed to provide the tapered shape as described above. Thus, a gap X between the side surface 54A of the fourth upper mount section 54 and the rear surface 46B of the upper mount holding section 46, and a gap Y between the side surface 55B of the fifth upper mount section 55 and the side surface 38B of the upper mount bracket 38 become relatively large (see FIG. 2) at a time when the rotating speed of the engine 14 is low and the forward thrust of the propeller 15 is small, while the gaps X and Y are decreased with the engine holder 20 being displaced backward (the direction of the arrow A in FIG. 4) as shown in FIG. 4 at a time when the rotating speed of the engine 14 is high and the forward thrust of the propeller 15 is large.

Therefore, when the rotating speed of the engine 14 is high and the forward thrust of the propeller 15 is large, the side surface 54A of the fourth upper mount section 54 abuts against the rear surface 46B of the upper mount holding section 46, and the side surface 55B of the fifth upper mount section 55 abuts against the side surface 38B of the upper mount bracket 38 even with a slight displacement in the lateral direction including the rolling direction and the yaw direction. As a result, there can be attained an effect such that both of the lateral displacement restriction function and the steering response when the rotating speed of the engine 14 is high and the forward thrust of the propeller 15 is large can be improved.

When the rotating speed of the engine 14 is low and the forward thrust of the propeller 15 is small, both of the gap X between the side surface 54A of the fourth upper mount section 54 and the rear surface 46B of the upper mount holding section 46, and the gap Y between the side surface 55B of the fifth upper mount section 55 and the side surface 38B of the upper mount bracket 38 are relatively large. More specifically, the gaps X and Y are set to be sufficiently large such that the side surface 54A and the rear surface 46B, and the side surface 55B and the side surface 38B do not interfere with each other even by occurrence of the vibration of the engine 14 during the low-speed rotation of the engine 14. As a result, there can be attained effects such that it is possible to ensure a favorable vibration transmission preventing function by the first upper mount section 51 during the low-speed rotation of the engine 14, and to reduce a requirement for machining accuracy of the fourth upper mount section 54 and the fifth upper mount section 55, thus reducing the manufacturing cost of the fourth and fifth upper mount sections 54 and 55.

Figure 5:
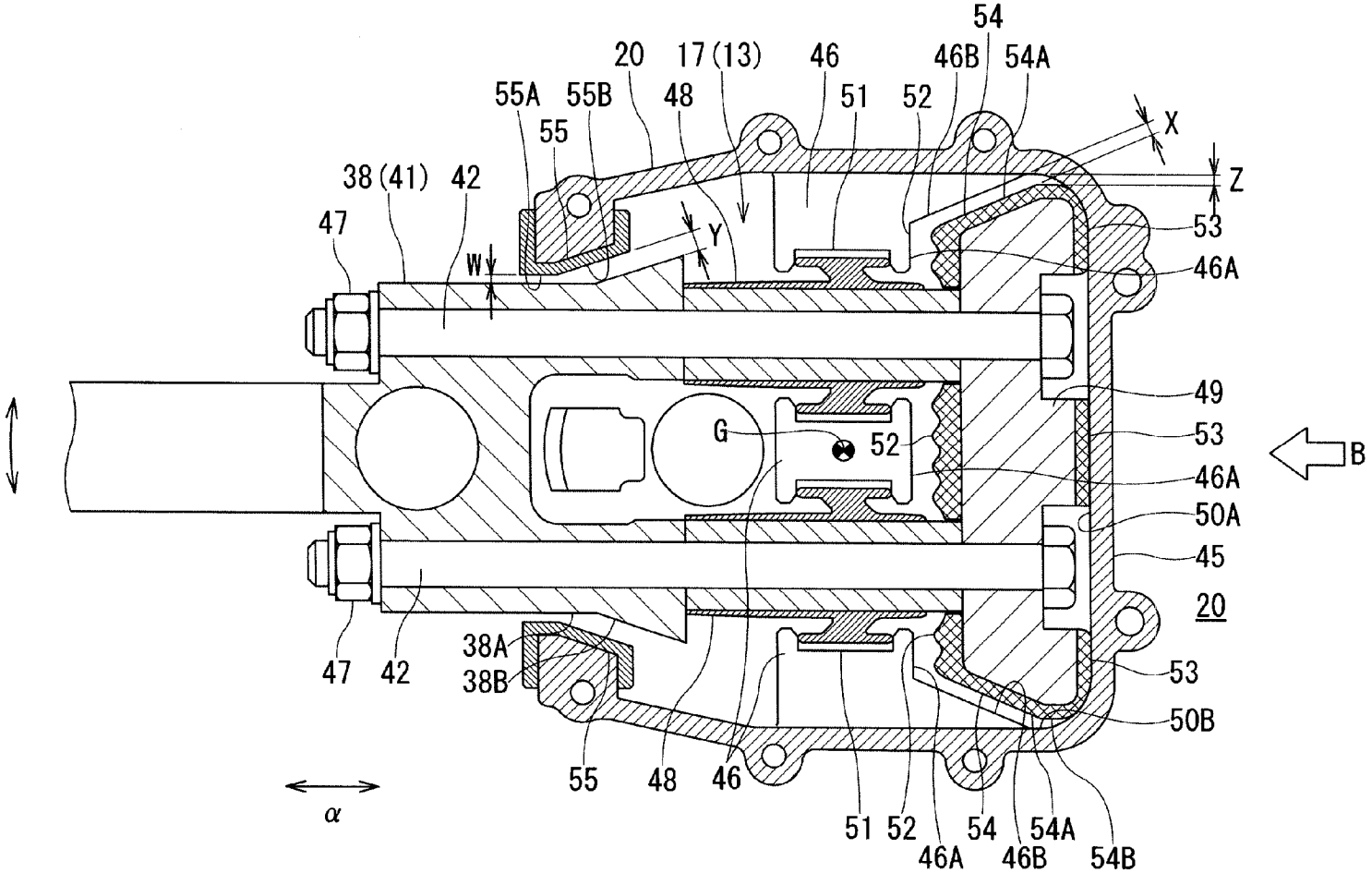
FIG. 5 is a sectional view corresponding to FIG. 2 illustrating a state of the upper mount unit during backward movement of the outboard motor.

Furthermore, both of the side surface 54B of the fourth upper mount section 54 and the rear side surface 50B of the upper mount accommodation section 45, and both the side surface 55A of the fifth upper mount section 55 and the side surface 38A of the upper mount bracket 38 are formed in parallel to the longitudinal (front-and-rear) direction α of the outboard motor body 11 as described above. Thus, a gap Z between the side surface 54B of the fourth upper mount section 54 and the rear side surface 50B of the upper mount accommodation section 45, and a gap W between the side surface 55A of the fifth upper mount section 55 and the side surface 38A of the upper mount bracket 38 are substantially constant without being changed even if the engine holder 20 is displaced forward (in the direction shown with the arrow B in FIG. 5) as shown in FIG. 5 due to the generation of the backward thrust of the propeller 15. Therefore, there can be attained effects such that it is possible to prevent a decrease in the lateral displacement restriction function and the steering response when the backward thrust is generated by the propeller 15, and to ensure a favorable vibration transmission preventing function by the first upper mount section 51.

Although the side surface 54B of the fourth upper mount section 54 has an area smaller than the side surface 54A and the side surface 55A of the fifth upper mount section 55 has an area smaller than the side surface 55B, the displacement in the lateral direction including the rolling direction and the yaw direction when the backward thrust is generated by the propeller 15 can be sufficiently restricted because the speed of the hull 16 is low and the lift generated on the gear case 23 during the steering operation is also small when the backward thrust is generated by the propeller 15.

Figure 6:
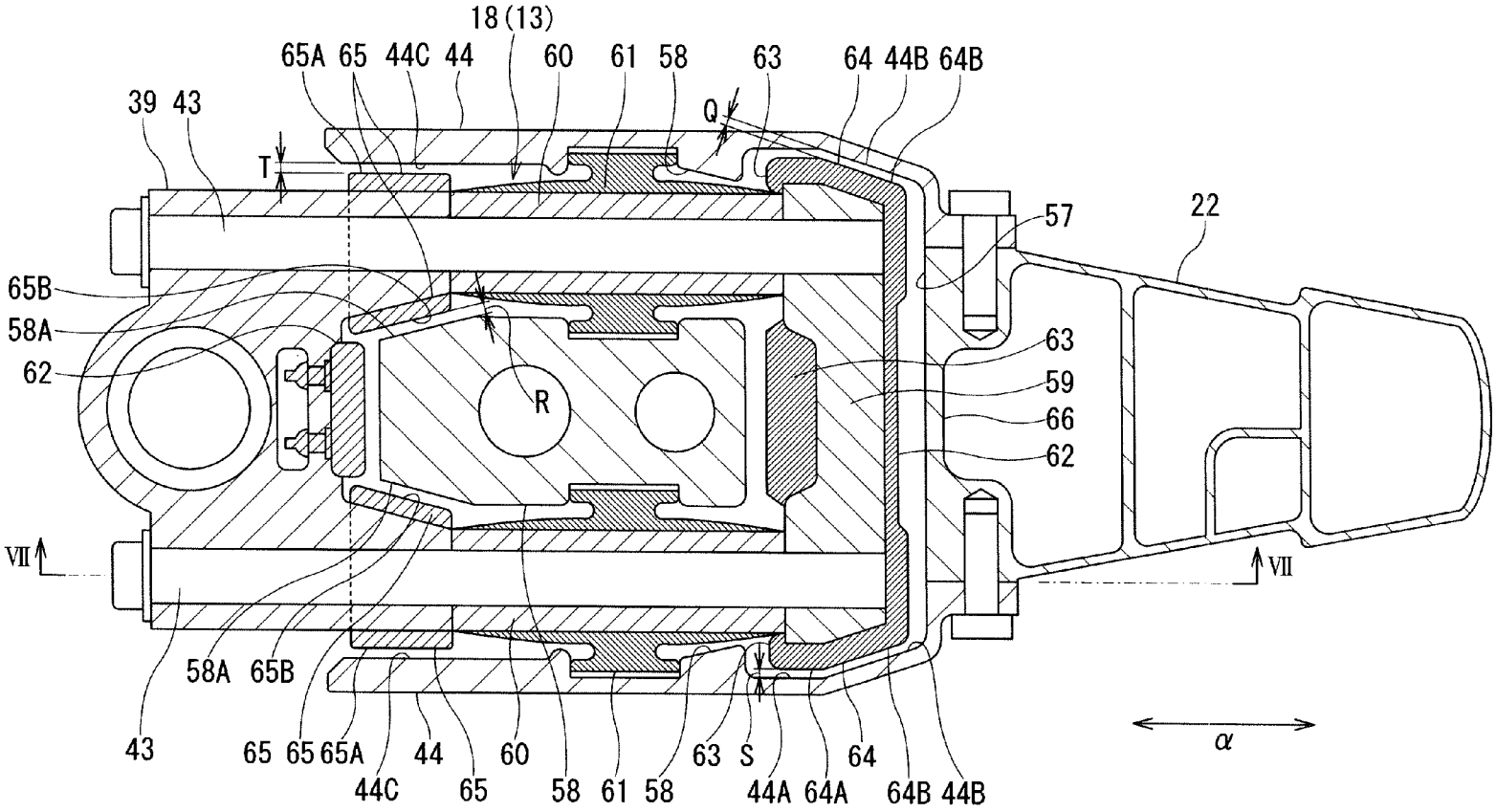
FIG. 6 is a sectional view of a lower mount unit taken along the line VI-VI in FIG. 1.
Figure 7:
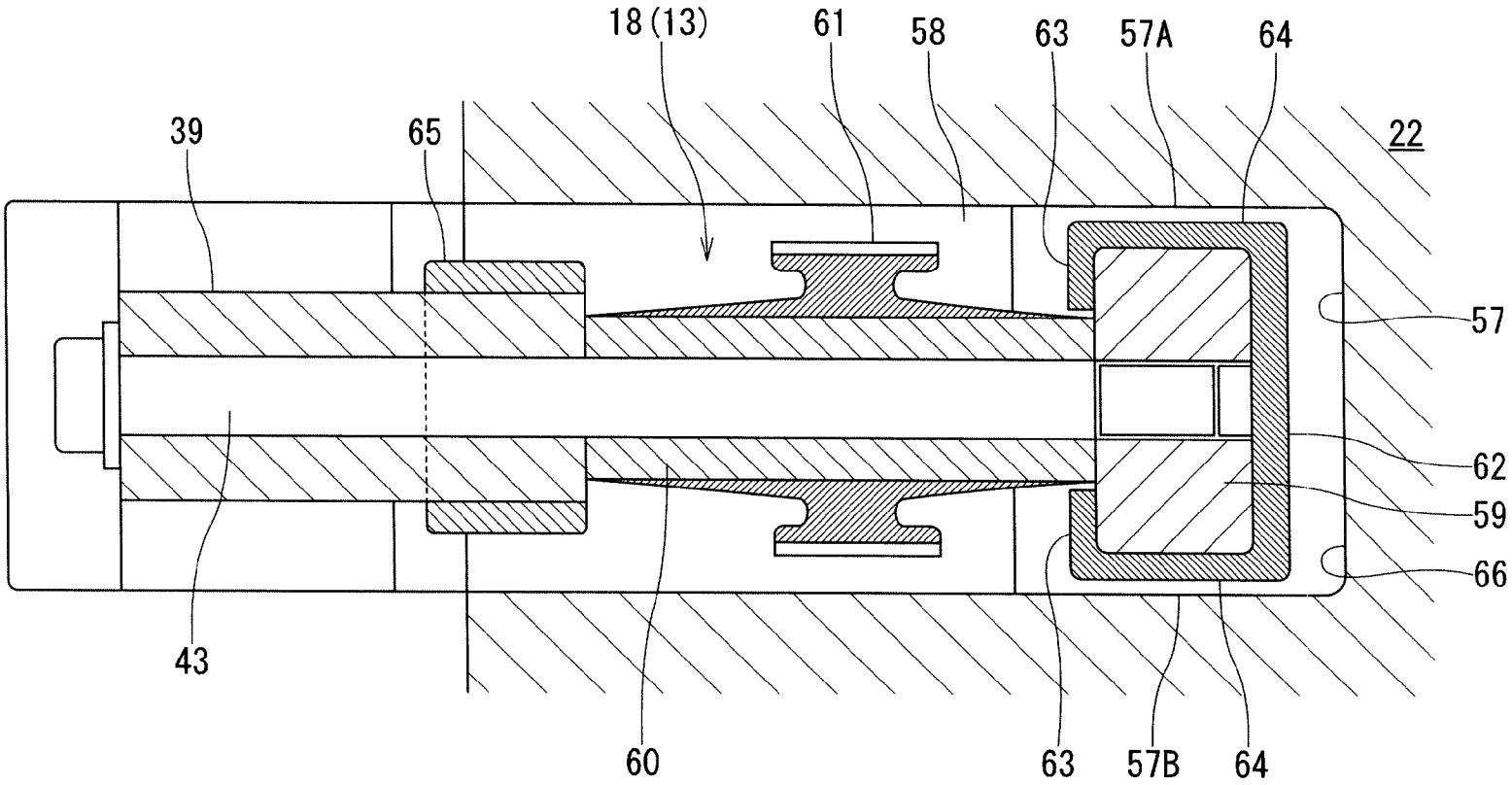
FIG. 7 is a sectional view taken along the line VII-VII in FIG. 6.

On the other hand, as shown in FIGS. 1, 6, and 7, the lower mount accommodation sections 57 that accommodate the lower mount units 18 are formed in both the opposite side surface portions of the drive shaft housing 22. Each of the lower mount accommodation sections 57 is closed by the lower mount cover 44 to be removable in a width direction. A pair of lower mount holding sections 58 are formed in the lower mount accommodation section 57 and the lower mount cover 44 in the width direction of the outboard motor body 11 integrally with the lower mount accommodation section 57 and the lower mount cover 44. The lower mount units 18 are fixed to the lower mount bracket 39 with front end portions of the right and left two lower mount bolts 43 penetrating the lower mount bracket 39 and rear end portions thereof screwed to a core metal member 59 in a state in which the lower mount units 18 are accommodated in the lower mount accommodation sections 57 of the drive shaft housing 22.

Each of the lower mount units 18 includes first to fifth lower mount sections 61 to 65. The first lower mount section 61 formed of an elastic body such as rubber is wound around each of inner tubes 60 through which the right and left pair of lower mount bolts 43 are inserted, and the first lower mount section 61 is fitted to the lower mount holding sections 58 of the drive shaft housing 22 and the lower mount cover 44. The second lower mount section 62 formed of an elastic body such as rubber is interposed between the rear surface of the core metal member 59 and the rear wall 66 of the lower mount accommodation section 57 of the drive shaft housing 22, and between the rear surface center portion of the lower mount bracket 39 and the front surface of the mount holding section 58 of the drive shaft housing 22. The third lower mount section 63 formed of an elastic body such as rubber is interposed between the front surface center portion of the core metal member 59 and the rear surface of the lower mount holding section 58 of the drive shaft housing 22, and between opposite-side front ends of the core metal member 59 and the mount holding section 58 of the lower mount cover 44. The fourth lower mount section 64 formed of an elastic body such as rubber or a resin material is interposed between right and left opposite side surfaces and the upper surface and the lower surface close to the opposite side surfaces of the core metal member 59, and the lower mount cover 44. The fifth lower mount section 65 formed of an elastic body such as rubber or a resin material is interposed between an area of the lower mount bracket 39 around the lower mount bolt 43 inserted therein, and the lower mount holding section 58 of the drive shaft housing 22 and the lower mount cover 44.

The first lower mount section 61 functions as a vibration prevention mount member that prevents the vibration generated during the low-speed rotation of the engine 14 from being transmitted to the hull 16 and has a very small (soft) spring constant that enables movement in the longitudinal direction and the lateral direction. The spring constant of the first lower mount section 61 in the vertical direction is set to an appropriate value required for holding the load of the outboard motor body 11.

The second lower mount section 62 is attached to the rear surface of the core metal member 59 and the rear surface center portion of the lower mount bracket 39. A slight gap is formed between the rear wall 66 of the lower mount accommodation section 57 and the front surface of the lower mount holding section 58 of the drive shaft housing 22, which are members opposing to the rear surface of the second lower mount section 62. The drive shaft housing 22 of the outboard motor body 11 is displaced forward (in a direction shown with an arrow C in FIG. 8) by the forward thrust generated by the propeller 15 during the high-speed rotation of the engine 14 in the forward movement of the hull.

The second lower mount section 62 functions as a forward movement-side displacement restriction mount member that restricts the forward displacement of the drive shaft housing 22.

For example, when the drive shaft housing 22 of the outboard motor body 11 is displaced forward, the first lower mount section 61 is first deformed, and a displacement exceeding the displacement absorbed by the first lower mount section 61 is restricted by the rear surface of the second lower mount section 62 abutting against the rear wall 66 of the lower mount accommodation section 57 of the drive shaft housing 22 and the front surface of the lower mount holding section 58 of the drive shaft housing 22.

Therefore, the spring constant of the second lower mount section 62 is set to a spring constant large enough to prevent vibration transmission of a constant level, and restrict the displacement by the forward thrust of the propeller 15, that is, is set to an intermediate level larger than the spring constant of the first lower mount section 61. When the forward thrust is generated by the propeller 15, the rear surface of the second lower mount section 62 is maintained in a state in abutment against the rear wall 66 of the lower mount accommodation section 57 of the drive shaft housing 22 and the front surface of the lower mount holding section 58 of the drive shaft housing 22, and a steering force is transmitted to the entire outboard motor body 11 through the drive shaft housing 22.

The third lower mount section 63 is attached to the front surface center portion of the core metal member 59 and the opposite-side front ends of the core metal member 59. A slight gap is formed between the rear surface of the lower mount holding section 58 of the drive shaft housing 22 and the lower mount holding section 58 of the lower mount cover 44, which are members opposing to the front surface center portion of the core metal member 59 and the opposite-side front ends of the core metal member 59. The drive shaft housing 22 of the outboard motor body 11 is displaced backward (in a direction shown with an arrow D in FIG. 9) by the backward thrust of the propeller 15 during the backward movement of the hull. The third lower mount section 63 functions as a backward movement-side displacement restriction mount member that restricts the backward displacement of the drive shaft housing 22.

For example, when the drive shaft housing 22 of the outboard motor body 11 is displaced backward, the first lower mount section 61 is first deformed, and a displacement exceeding the displacement absorbed by the first lower mount section 61 is restricted by the front surface of the third lower mount section 63 abutting against the lower mount holding section 58 of the drive shaft housing 22 and the lower mount holding section 58 of the lower mount cover 44. The spring constant of the third lower mount section 63 is set to an intermediate level similarly to the second lower mount section 62.

The fourth lower mount section 64 and the fifth lower mount section 65 are arranged on the respective sides of the longitudinal direction α of the outboard motor body 11 with the first lower mount section 61 being disposed therebetween as shown in FIGS. 6 and 7. That is, the fourth lower mount section 64 is attached so as to cover the right and left opposite side surfaces and the upper surface and the lower surface close to the opposite side surfaces of the core metal member 59. A slight gap is formed between the side surfaces 44A and 44B of the lower mount cover 44, and an upper surface 57A and a lower surface 57B of the lower mount accommodation section 57, which are opposing members. The fifth lower mount section 65 is attached to the area of the lower mount bracket 39 around the lower mount bolt 43 that is inserted therein. A slight gap is formed between the front portion side surface 58A of the lower mount holding section 58 of the drive shaft housing 22 and a front-side inner surface 44C of the lower mount cover 44, which are opposing members.

The fourth lower mount section 64 and the fifth lower mount section 65 function as displacement restriction mount members for restricting displacement in the vertical direction, the lateral direction including the rolling and yaw directions of the outboard motor body 11 with respect to the hull 16 generated during the steering operation or when the hull 16 lands on water after jumping. For example, during the steering operation, a lift forth is generated to the underwater gear case 23 of the outboard motor body 11, and the outboard motor body 11 is displaced in the lateral direction by the lift. At this time, the first lower mount section 61 is first deformed. When a larger load is applied, the fourth lower mount section 64 abuts against the side surfaces 44A and 44B of the lower mount cover 44, and the fifth lower mount section 65 abuts against the front portion side surface 58A of the lower mount holding section 58 of the drive shaft housing 22 and the front-side inner surface 44C of the lower mount cover 44 to thereby restrict the displacement, respectively.

Therefore, spring constants of the fourth lower mount section 64 and the fifth lower mount section 65 are set to spring constants capable of restricting the displacement of the outboard motor body 11 even when an excessive load is applied, that is, spring constants larger than the spring constants of the second lower mount section 62 and the third lower mount section 63.

Further, a side surface 64B acting as an abutment surface of the fourth lower mount section 64 and the side surface 44B acting as an abutment surface of the lower mount cover 44 that opposes the side surface 64B are formed in a tapered shape in which a rear side is inclined with respect to the longitudinal direction α of the outboard motor body 11. Furthermore, a side surface 64A acting as an abutment surface of the fourth lower mount section 64 and the side surface 44A acting as an abutment surface of the lower mount cover 44 that opposes the side surface 64A are formed in parallel to the longitudinal direction α of the outboard motor body 11.

On the other hand, a side surface 65A acting as an abutment surface of the fifth lower mount section 65 and the front-side inner surface 44C acting as an abutment surface of the lower mount cover 44 that opposes the side surface 65A are formed in parallel to the longitudinal direction α of the outboard motor body 11. A side surface 65B acting as an abutment surface of the fifth lower mount section 65 and the front portion side surface 58A acting as an abutment surface of the lower mount holding section 58 of the drive shaft housing 22 that opposes the side surface 65B are formed in a tapered shape in which a rear side is inclined to the inner side in the lateral direction with respect to the longitudinal direction α of the outboard motor body 11.

Figure 8:
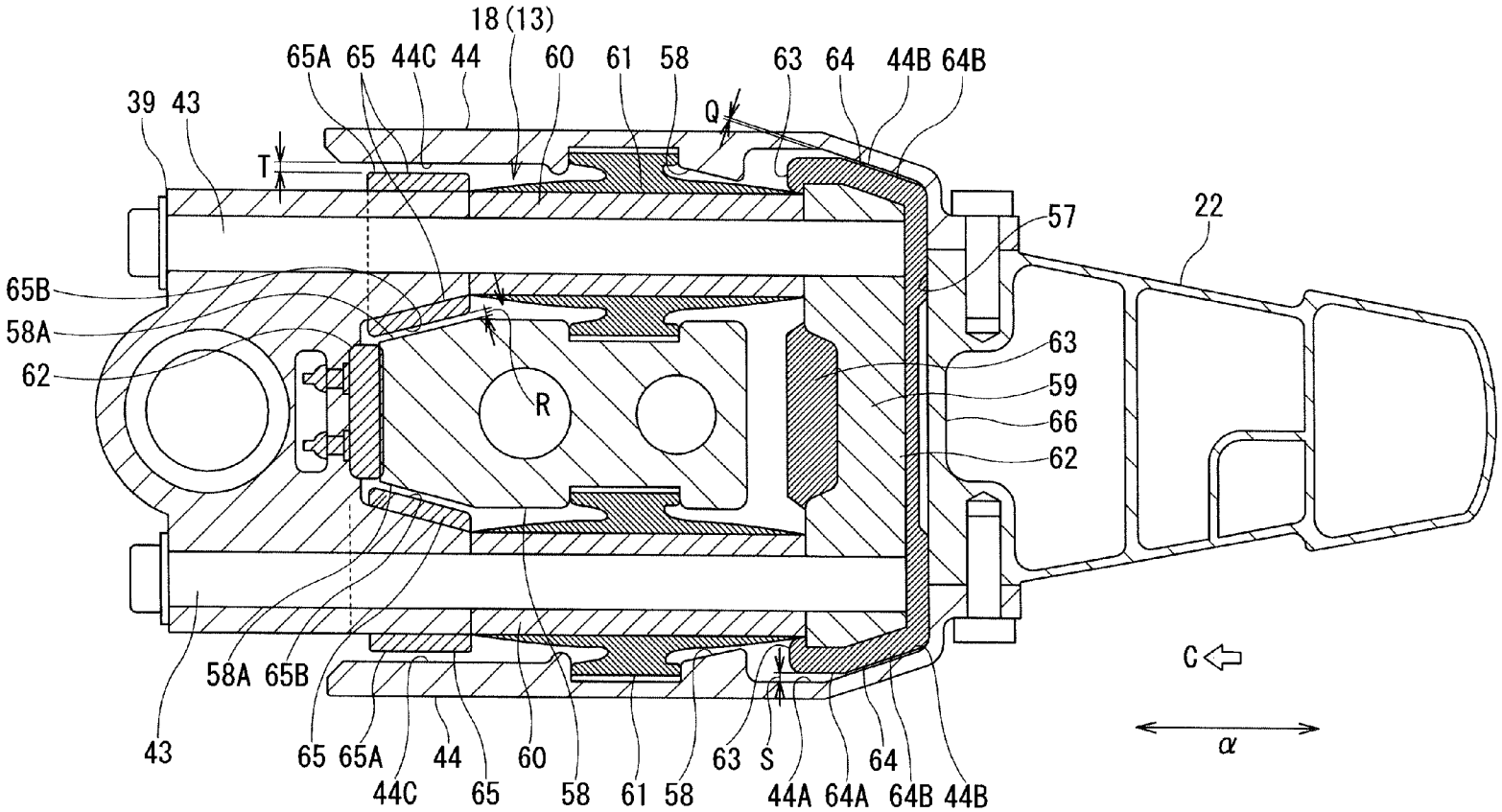
FIG. 8 is a sectional view corresponding to FIG. 6 illustrating a state of the lower mount unit during forward movement of the outboard motor.

Both the side surface 64B of the fourth lower mount section 64 and the side surface 44B of the lower mount cover 44, and both the side surface 65B of the fifth lower mount section 65 and the front portion side surface 58A of the lower mount holding section 58 of the drive shaft housing 22 are formed in a tapered shape as described above. Thus, a gap Q between the side surface 64B of the fourth lower mount section 64 and the side surface 44B of the lower mount cover 44, and a gap R between the side surface 65B of the fifth lower mount section 65 and the front portion side surface 58A of the lower mount holding section 58 of the drive shaft housing 22 are relatively large (see FIG. 6) at a time of the low rotating speed of the engine 14 and the small forward thrust of the propeller 15, while the gaps Q and R are decreased with the drive shaft housing 22 displaced forward (the direction of the arrow C in FIG. 8) as shown in FIG. 8 at a time of high rotating speed of the engine 14 and the large forward thrust of the propeller 15.

Therefore, in the operation at the time when the rotating speed of the engine 14 is high and the forward thrust of the propeller 15 is large, the side surface 64B of the fourth lower mount 64 section abuts against the side surface 44B of the lower mount cover 44, and the side surface 65B of the fifth lower mount section 65 abuts against the front portion side surface 58A of the lower mount holding section 58 of the drive shaft housing 22 even with slight displacement in the lateral direction including the rolling and yaw directions. As a result, there can be attained an effect such that both of the displacement restricting function and a steering response at the time of the high rotating speed of the engine 14 and the large forward thrust of the propeller 15 can be improved.

During the low rotating speed of the engine 14 with the small forward thrust of the propeller 15, both of the gap Q between the side surface 64B of the fourth lower mount section 64 and the side surface 44B of the lower mount cover 44, and the gap R between the side surface 65B of the fifth lower mount section 65 and the front portion side surface 58A of the lower mount holding section 58 of the drive shaft housing 22 became relatively large. More specifically, the gaps Q and R are set to be large enough not to interfere the side surface 64B and the side surface 44B, and the side surface 65B and the front portion side surface 58A with each other even by the vibration of the engine 14 during the low rotating speed of the engine 14. As a result, there can be attained effects such that it is possible to ensure a favorable vibration transmission preventing function by the first lower mount section 61 during the low rotating speed operation of the engine 14, and to reduce a requirement for machining accuracy of the fourth and fifth lower mounts 64 and 65, thereby reducing the manufacturing cost of these fourth and fifth lower mounts 64 and 65.

Figure 9:
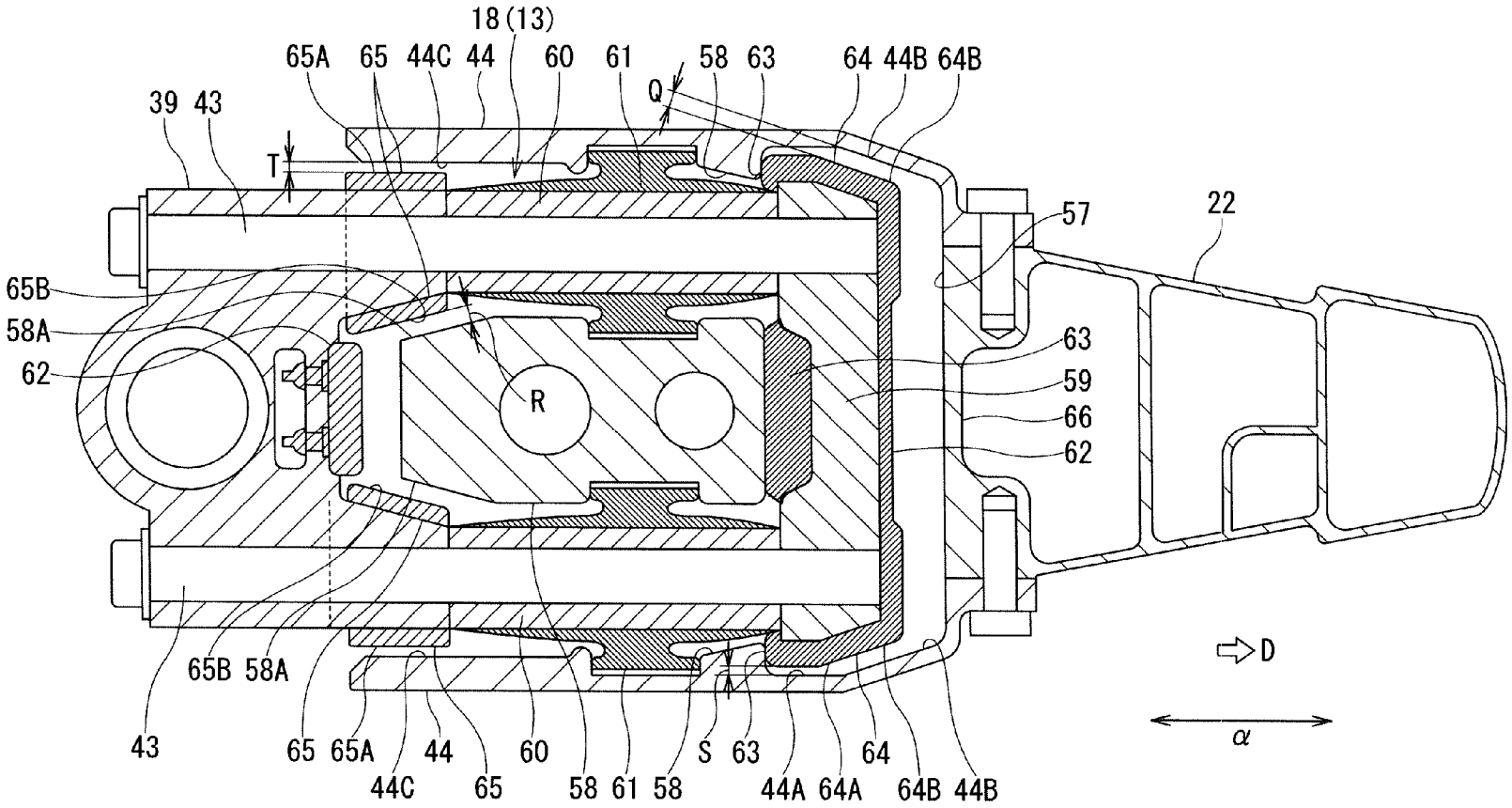
FIG. 9 is a sectional view corresponding to FIG. 6 illustrating a state of the lower mount unit during backward movement of the outboard motor.
Figure 10:
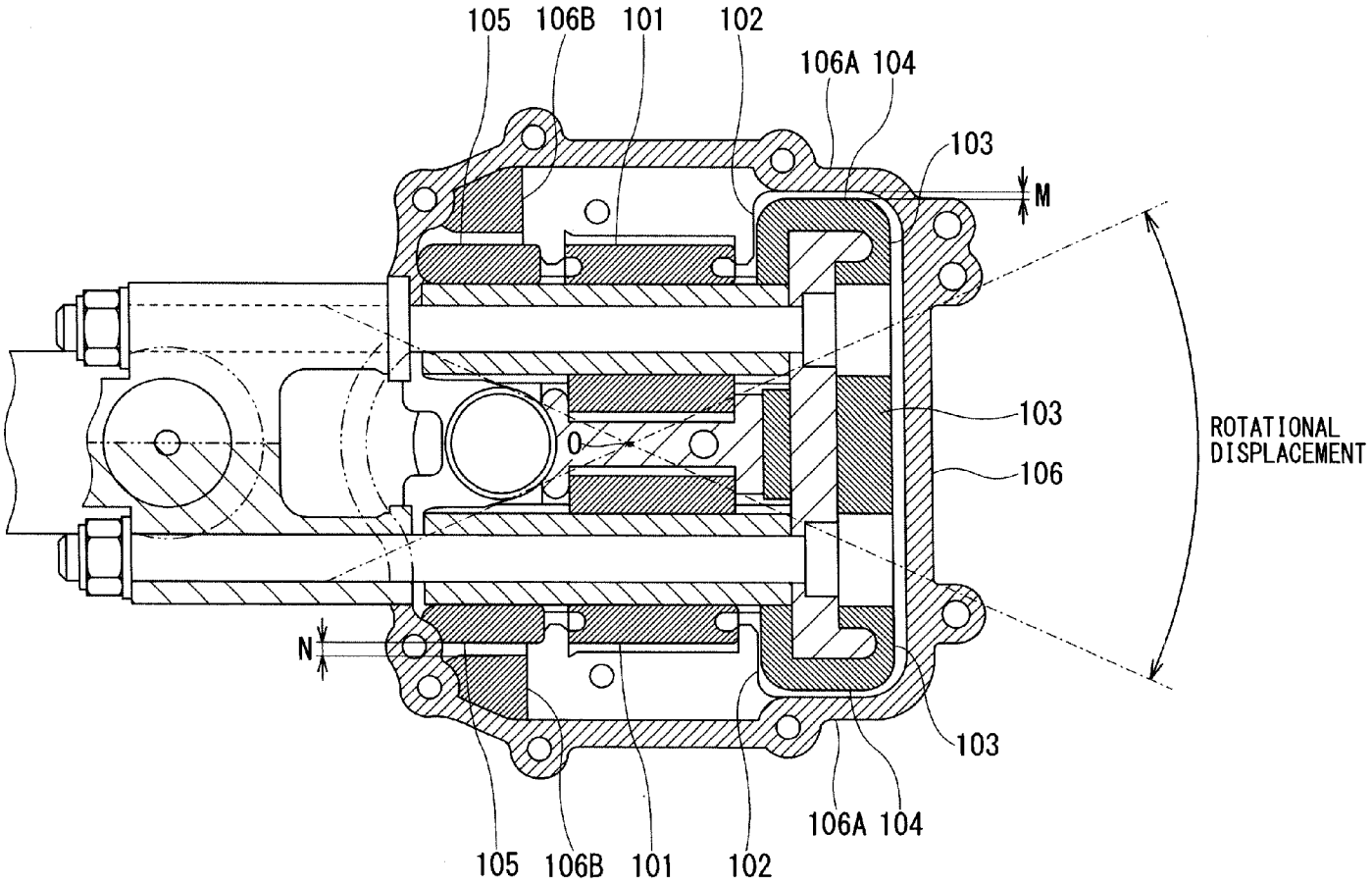
FIG. 10 is a sectional view illustrating a conventional upper mount unit.

Furthermore, both of the side surface 64A of the fourth lower mount section 64 and the side surface 44A of the lower mount cover 44, and the side surface 65A of the fifth lower mount section 65 and the front-side inner surface 44C of the lower mount cover 44 are formed in parallel to the longitudinal direction α of the outboard motor body 11 as described above. Thus, a gap S between the side surface 64A of the fourth lower mount section 64 and the side surface 44A of the lower mount cover 44, and a gap T between the side surface 65A of the fifth lower mount section 65 and the front-side inner surface 44C of the lower mount cover 44 are substantially constant without being changed even if the drive shaft housing 22 is displaced backward (in the direction shown with the arrow D) as shown in FIG. 9 due to the generation of the backward thrust of the propeller 15. Accordingly, there can be attained effects such that it is possible to prevent a decrease in the lateral displacement restriction function and the steering response when the backward thrust is generated by the propeller 15, and to ensure a favorable vibration transmission preventing function by the first lower mount section 61.

Although the side surface 64A of the fourth lower mount section 64 has an area smaller than the side surface 64B and the side surface 65A of the fifth lower mount section 65 has an area smaller than the side surface 65B, the displacement in the lateral direction including the rolling and yaw directions when the backward thrust is generated by the propeller 15 can be sufficiently restricted because the speed of the hull 16 is low and the lift generated on the gear case 23 during the steering operation is also small when the backward thrust is generated by the propeller 15.

It is to be noted that although the embodiment of the present invention has been described above, the embodiment is merely illustrative, and does not intend to limit the scope of the present invention. The present invention may be carried out other than the embodiment described above in various other forms, and various omission, replacements, and changes may be also made without departing from the scope of the present invention.

REFERENCE NUMERAL

10—outboard motor, 11—outboard motor body, 12—attachment bracket device (attachment device), 13—mount device, 14—engine, 15—propeller, 16—hull, 17—upper mount unit, 18—lower mount unit, 20—engine holder, 22—drive shaft housing, 38B—side surface (abutment surface), 44—lower mount cover, 44B—side surface (abutment surface), 46B—44B—rear surface (abutment surface), 51—first upper mount section (vibration preventing mount), 52—second upper mount section (forward-movement side displacement restriction mount), 53—third upper mount section (backward side displacement restriction mount), 54—fourth upper mount section (lateral direction displacement restriction mount), 55—fifth upper mount section (lateral direction displacement restriction mount), 54A, 54B—side surface (abutment surface), 57—lower mount accommodation portion, 58—lower mount holding portion, 58A—front-side side surface (abutment surface), 59—core metal member, 61—first lower mount section, (vibration prevention mount), 62—second lower mount section (forward-movement side displacement restriction mount), 63—third lower mount section (backward side displacement restriction mount), 64—fourth lower mount section (lateral direction displacement restriction mount), 65—fifth lower mount section (lateral direction displacement restriction mount), 64B, 65A, 65B—side surface (abutment surface), α—longitudinal (front-and-rear) direction.

The invention claimed is:

1. A mount device for an outboard motor having an outboard motor body generating a thrust by rotating a propeller that is driven by an engine mounted to the outboard motor and an attachment device configured to attach the outboard motor body to a hull, the mount device comprising:

an upper mount unit and a lower mount unit arranged between the outboard motor body and the attachment device for attaching the outboard motor body to the hull and configured to support the outboard motor body, the upper and lower mount units each further comprising first upper and lower mount sections that prevent vibration of the engine during low-speed rotation of the engine from being transmitted to the hull, a forward-movement side displacement restriction mount section that restricts displacement of the outboard motor body during high-speed rotation of the engine and during forward movement of the hull, a backward-movement side displacement restriction mount section that restricts displacement of the outboard motor body during backward movement of the hull, and a lateral displacement restriction mount section that restricts displacement in a lateral direction including a rolling direction and a yaw direction of the outboard motor body, and wherein the lateral displacement restriction mount section and a member opposing to the lateral displacement restriction mount section are configured to abut against each other at abutment surfaces thereof during forward thrust of the propeller, the abutment surfaces being configured to be inclined with respect to a longitudinal direction of the outboard motor body.

2. The mount device for an outboard motor of claim 1, wherein the lateral displacement restriction mount section of the upper mount unit is arranged on respective sides of the longitudinal direction of the outboard motor body with the first upper mount section being disposed therebetween.

3. The mount device for an outboard motor of claim 1, wherein the lateral displacement restriction mount section of the lower mount unit is installed on each of opposing lateral side surfaces of a core metal member at which the forward-movement side displacement restriction mount section and the backward-movement side displacement restricting mount section are mounted.

4. The mount device for an outboard motor of claim 1, wherein the lateral displacement restriction mount section of the upper mount unit is installed on an engine holder of the outboard motor body that supports the engine in a manner opposing displacement of an upper mount bracket.

5. The mount device for an outboard motor of claim 1, wherein the lateral displacement restriction mount section of the lower mount unit is mounted on a lower mount bracket with a portion of a drive shaft housing of the outboard motor body being formed to oppose lateral displacement of the lower mount bracket.

6. The mount device for an outboard motor of claim 1, wherein the upper and lower mounts and each of the displacement restriction mounts have spring constants that are set to prevent vibration transmission.

* * * * *